US006264796B1

(12) United States Patent
Simmons

(10) Patent No.: US 6,264,796 B1
(45) Date of Patent: Jul. 24, 2001

(54) HEADBOX DIFFUSER

(75) Inventor: Stephen G. Simmons, Chillicothe, OH (US)

(73) Assignee: The Mead Corporation, Dayton, OH (US)

( * ) Notice: Subject to any disclaimer, the term of this patent is extended or adjusted under 35 U.S.C. 154(b) by 0 days.

(21) Appl. No.: 09/352,595

(22) Filed: Jul. 13, 1999

(51) Int. Cl.[7] ..... D21F 1/00; D21F 1/06
(52) U.S. Cl. ..... 162/216; 162/343; 162/336
(58) Field of Search ..... 162/216, 343, 162/336, 344, 347; 366/336, 337, 338, 340

(56) References Cited

U.S. PATENT DOCUMENTS

| | | | | |
|---|---|---|---|---|
| 3,272,233 | | 9/1966 | Trufitt . | |
| 3,328,236 | | 6/1967 | Burgess, Jr. et al. . | |
| 3,400,044 | | 9/1968 | Justus . | |
| 3,486,972 | * | 12/1969 | Nagell | 162/343 |
| 3,627,039 | * | 12/1971 | Tiefenbacher | 165/158 |
| 3,725,197 | | 4/1973 | Dahl et al. . | |
| 3,770,580 | | 11/1973 | Kallmes et al. . | |
| 3,856,619 | | 12/1974 | Davidson et al. . | |
| 3,977,938 | | 8/1976 | Descary et al. . | |
| 4,206,806 | * | 6/1980 | Togashi | 165/82 |
| 4,897,160 | | 1/1990 | Wolf et al. . | |
| 5,019,215 | | 5/1991 | Fortier et al. . | |
| 5,183,537 | | 2/1993 | Hergert et al. . | |
| 5,510,005 | | 4/1996 | Gingerich . | |
| 5,626,722 | | 5/1997 | Huovila . | |
| 5,741,401 | | 4/1998 | Heinzmann . | |

* cited by examiner

*Primary Examiner*—Stanley S. Silverman
*Assistant Examiner*—Dionne A. Walls
(74) *Attorney, Agent, or Firm*—Thompson Hine & Flory LLP

(57) ABSTRACT

A diffuser section for use in a headbox, the diffuser section comprising a plurality of hollow diffusers, each diffuser having an outlet and an inlet that is shaped as a polygon. The plurality of diffusers are arranged such that the inlet of each the diffusers abuts against an adjacent diffuser inlet such that there are generally no gaps therebetween.

26 Claims, 4 Drawing Sheets

HEADBOX DIFFUSER

The present invention is directed to a diffuser section for a paper making headbox, and more particularly, to a diffuser system for a paper making headbox which minimizes the wall areas adjacent the inlets of the diffuser system to reduce streaking in the finished paper product.

BACKGROUND OF THE INVENTION

In the paper making industry, paper is ultimately formed from a mixture of fibers suspended in a solution of primarily water. Once the fibrous slurry is produced, it is fed to a headbox including a distribution system, a turbulence generating section, and a nozzle. Flow entering the headbox first enters the distribution system. The distribution system is typically utilized to normalize the properties of the slurry, such as the consistency, pressure, and velocity. Flow exiting the distribution system enters into the turbulence generating section, which is termed a diffuser section in hydraulic headboxes. The turbulence generating section delivers flow to a nozzle. The slurry then flows through the nozzle and is deposited in jet form onto a conveyer or wire. The slurry is then dried and treated to form the finished product.

It is important the slurry be sufficiently agitated while it is transported through the diffuser system and nozzle because the agitation keeps the fibers generally uniformly suspended throughout the fluid, and maintains random fiber orientation. If the fibers are not generally uniformly distributed (i.e., if areas of higher concentration exist), and are not randomly oriented (i.e., if some of the fibers are aligned) the resultant product may have "streaks," which are areas of structural variation in the paper. Streaks are manifested in paper sheets that are distorted such that the paper sheet does not lie flat.

FIG. 1 illustrates a typical prior art diffuser section wherein the slurry flow, or pulp flow is fed from the distribution system 64 to the diffuser section 50. The diffuser section 50 is comprised of a series of parallel, bundled tubes 52 that are anchored in an inlet wall 54. The incoming pulp flow 56 impinges upon the inlet wall 54 and ultimately enters the diffuser pipes 52 at an inlet 58. The flow through each of the diffuser tubes 52 is exhausted into a nozzle area (not shown). In order to maintain the agitation of the pulp, the walls of the tubes 52 typically diverge in the downstream direction (not shown) to create an adverse pressure gradient (i.e. a pressure gradient that decreases in the downstream direction). The pressure drop created at each tube inlet 58, in combination with the adverse pressure gradient, introduces small-scale turbulence which maintains fiber suspension in the slurry, and helps to randomize the fiber orientation and distribution. The diffuser section thereby agitates the fluid through "controlled turbulence".

As noted above, the tubes 52 are fit into holes formed in an inlet wall 54. The solid portions 60 of the wall are flow stagnation areas, and the tube inlets 58 are flow sinks. The distribution system 64 supplies the pulp flow 56 and is thus a flow source. A model for describing the arrangement of vortices in a two dimensional flow, known at the vonKarman vortex street, predicts that the symmetric positioning of stagnations (60) and sinks (58) in the presence of a source (56) introduces a series of oscillating vortices. Applicant has extended this concept to three dimensions, and applied the concept to headboxes. Applicant has discovered that vortices in the diffuser tubes may be created by dead spots 60 on the diffuser section wall 54. The vortices may then travel down each diffuser section tube 52 either in succession, or in a set pattern. When the vortices exit the diffuser tubes (indicated at 62), the exiting vortices create secondary flows, which are flows in a circular direction that causes the fibers to align and/or concentrate. The secondary flows align the fibers in the pulp, and repeated secondary flows cause the aligned fibers to appear as "streaks" in the finished paper products. As noted earlier, streaks are areas of structural variation in the paper believed to be caused by aligned of fibers. Streaks may cause mechanical condition defects in the papers, which can result in paper that will not lie flat (i.e., warped or buckled paper). Therefore, it appears that the presence of streaks may be attributed to the vortices 62, that in turn may be attributed to stagnation points 60 on the diffuser wall 54.

There have been prior art attempts to reduce or eliminate the effects of secondary flows. However, most of these efforts focus upon minimizing the effect of secondary flows, and have not addressed the source of secondary flows. Accordingly, there exists a need for a diffuser section which can minimize stagnation areas on the inlet wall and thereby minimize vortices that cause secondary flows and streaking in the finished paper.

SUMMARY OF THE INVENTION

The present invention is a diffuser section which effectively reduces or eliminates the inlet stagnation wall area and thereby minimizes the formation of vortices and secondary flows. The invention utilizes diffuser tubes having inlets that may interfit together, thereby effectively eliminating the inlet wall. More particularly, the present invention is a diffuser section for use in a headbox, the diffuser section comprising a plurality of hollow diffusers, each diffuser having an outlet and an inlet that is shaped as a polygon. The plurality of diffusers are arranged such that the inlet of each the diffuser abuts against an adjacent diffuser inlet such that there are generally no gaps therebetween to minimize stagnation points.

Other objects and advantages of the present invention will become apparent from the following description, the accompanying drawings and the appended claims.

DETAILED DESCRIPTION

Figure 1:
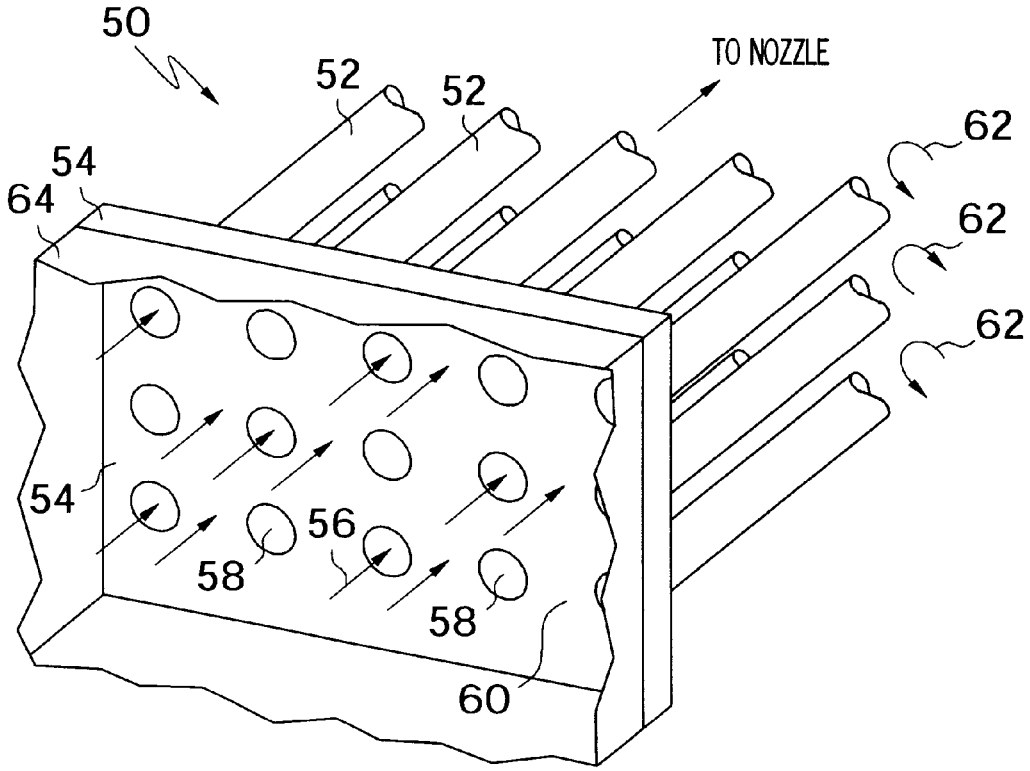
FIG. 1 (PRIOR ART)
FIG. 1 is a perspective, partial view of a prior art diffuser section and distribution system.
Figure 2:
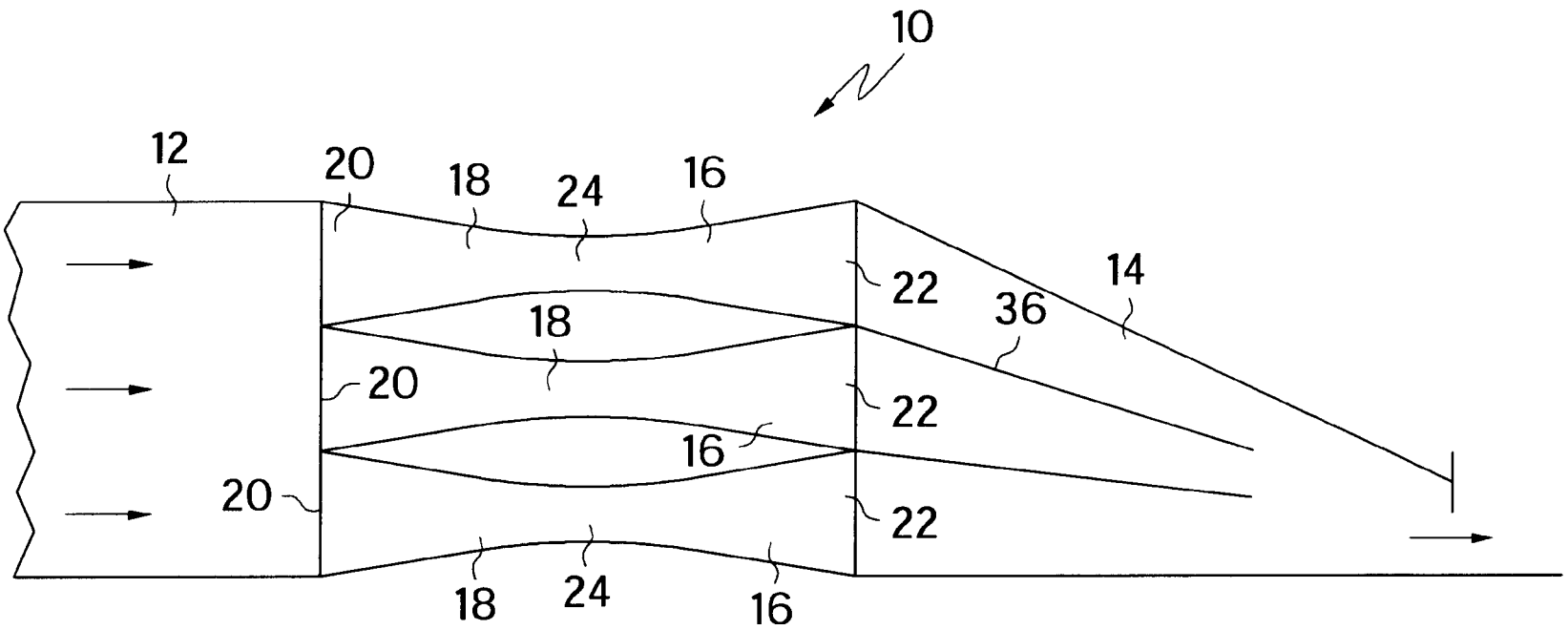
FIG. 2 is a side cross-sectional view of the diffuser section of the present invention, shown with a distribution system and a nozzle.

As shown in FIG. 2, the present invention is a diffuser section 10 which receives pulp from a distribution system 12 and guides it into the nozzle 14. The diffuser section 10 is comprised of a plurality of diffuser tubes 16, each tube 16 having a generally hollow body 18, an inlet 20 and an outlet 22. Each diffuser tube 16 typically has an inlet area of about ¼ to 4 square inches, and an outlet area of about ¼ to 4 square inches. The walls of the diffuser tubes 16 are typically about 1/16 to ¼ inches thick, and the tubes 16 have a length of about 6 to about 18 inches.

Figure 3:
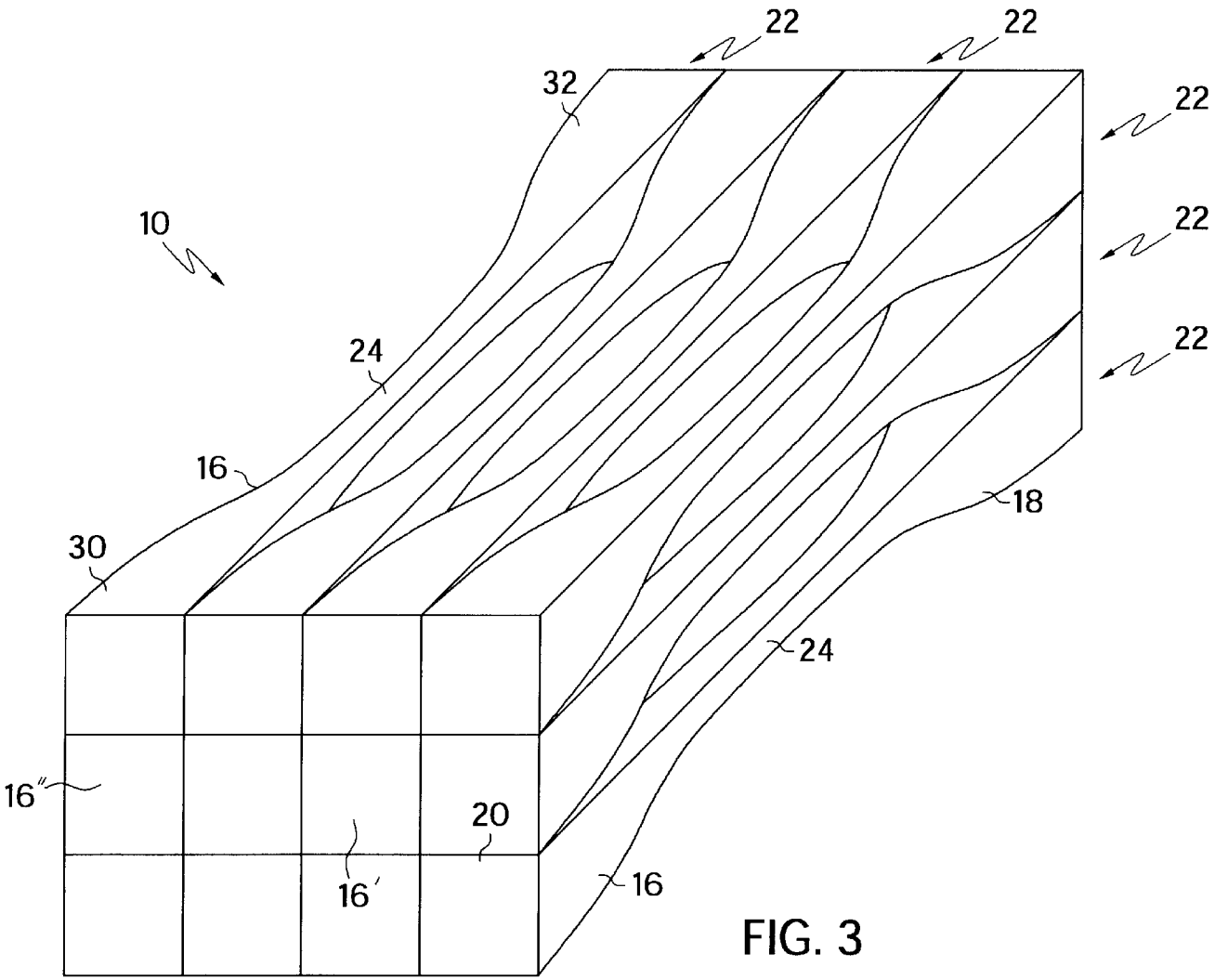
FIG. 3 is a perspective view of the diffuser section of FIG. 2.
Figure 4:
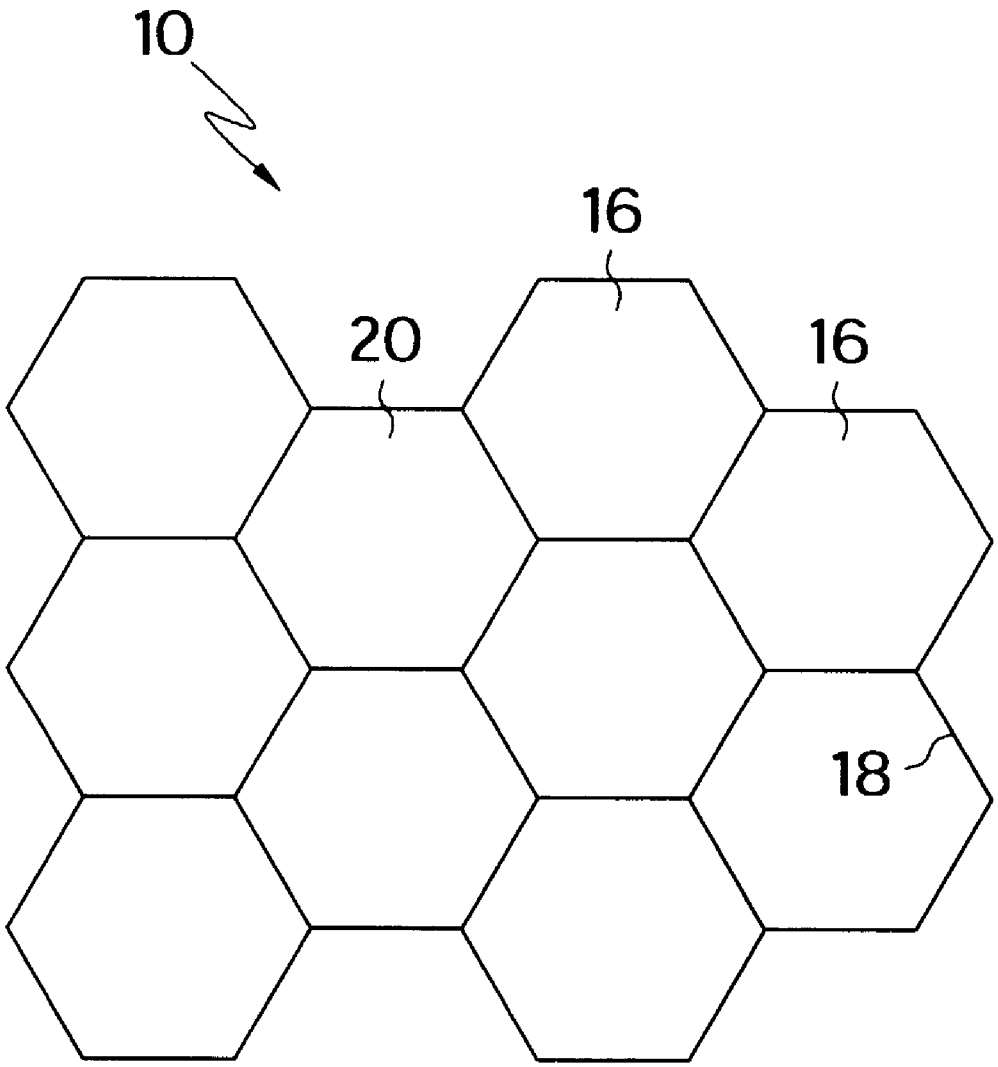
FIG. 4. is a front view of an alternate embodiment of the diffuser section of the present invention.

As shown in FIG. 3, the inlets 20 of the tubes 16 are designed to be contiguously nested to fit together with adjacent diffuser tubes. For example, a tube having a hexagonal inlet will fit up against six other tube inlets having the same shape. Similarly, a tube having a square inlet will fit up against four other tube inlets having the same shape (although a square tube inlet may be considered to contact a total of eight adjacent tube inlets when the comer contacts are taken into consideration). In this manner, the inlets 20 of each of the tubes 16 may fit together, thereby effectively eliminating the inlet wall. Preferably, substantially no gaps are formed between adjacent tube inlets 20. This elimination of the diffuser section wall helps to reduce vortices, and therefore reduces secondary flows and streaks in the paper. Although the illustrated embodiment shows the inlets 20 being square in end view, any other polygon or combination of polygon shapes which can nest with each other may be used. For example, nearly any polygon such as a square, triangle, hexagon or the like may be used. Additionally, diffuser tubes having two or more inlet shapes may be utilized, so long as they fit together to form a generally continuous "wall" of inlets, preferably fitting together in a two-dimensional plane.

All that is required for the tubes of the present invention is that the inlet of one tube fittingly abut the inlets of any adjacent tubes. Each tube is preferably designed such that its inlet has a plurality of sides, and each side of the inlet is adjacent a side of another inlet with generally no gaps therebetween. A tube located near the center of a bundle of tubes (for example, tube 16' of FIG. 3) is thereby preferably surrounded by abutting inlet tubes, while a tube on the outer edge of a bundle the tubes (for example, tube 16" of FIG. 3) may not be surrounded on all sides by adjacent tubes. Thus, each side of the inlet 20 of each tube 16 preferably abuts against the inlet sides of any adjacent tube. Preferably, the tubes 16 abut with no space therebetween. However, the diffuser section 10 may include a small but functionally insignificant surface or space between the tubes 16 without departing from the scope of the present invention. The objective is to minimize stagnation points and thereby prevent streaking.

It should be understood that the diffuser tubes of the present invention may assume various shapes. For example, although the diffuser tubes 16 of FIG. 3 have a converging section 30, a throat section 24 and a diverging section 32, the tubes 16 may include only a diverging section 32 extending from the inlet 20. Furthermore, the tubes may include a convergent section 30 that immediately transitions into a diverging section 32; that is, the throat section 24 may be minimized or eliminated. Besides the inlet 20, the shapes of the other sections of the tube is not critical. All that is required is that the inlet 20 be of a shape to fit together with other inlet shapes to minimize land area. Thus, the inlet 20 cross section need not be identical in size or shape of that of the outlet 22, and the converging section 30 need not be identical in size, shape or length to the diverging section 32.

In a preferred embodiment, the cross section of the throat 24 is generally circular in cross section. The diffuser tubes 16 of the present invention may be used with nearly any type of pressure distribution system 12 or nozzle 14. For example, the diffuser section 10 of the present invention may be used in headboxes designed for flat fourdriniers as well as gap formers, and the nozzle 14 may utilize vanes 36 (FIG. 2) or lamella. Finally, the diffuser tubes 16 of the present invention may be used within multi-ply or stratified headboxes.

Another advantage of the diffuser section 10 of the present invention is that it may provide a reduced pressure drop, thus reducing the system energy requirements. For example, the pressure of the pulp flow entering one diffuser tube 16' may differ from the pressure from of the flow entering another diffuser tube 16" (FIG. 3). After passing through the diffuser tubes (16', 16"), the pressure differential at the outlets 22 of the tubes will be reduced relative to the pressure differential at the inlets. Therefore, the diffuser section 10 helps to normalize residual pressure gradients that remain after the flow passes through the distribution system, which helps to provide a more uniform flow of pulp. If incremental pressure reduction of the flow is desired in order to normalize differential pressures in the flow, or to permit improved head control, a series of diffusers 10 may be employed.

Headboxes used for forming paper may include diffuser sections at various locations throughout the headbox, and the present invention may be used at any location at which it is desired to deliver flow from one section of the headbox to another section. For example, a second diffuser section (not shown) may be located upstream of the distribution system 12 shown in FIG. 2. Furthermore, two separate diffuser sections may be used in place of the diffuser section 10 shown in FIG. 2. In this case, the diffuser sections may be mounted in series such that the exit flow of one diffuser section is fed to the inlet of the second diffuser section.

While the forms of the apparatus described herein constitute the preferred embodiment of the invention, the present invention is not limited to the precise forms and changes may be made therein without departing from the scope of the invention.

What is claimed is:

1. A papermaking system comprising:

a distributor for receiving a flow of pulp;

a nozzle for depositing a flow of pulp onto a conveyer; and a diffuser section for delivering said flow of pulp from said distributor to said nozzle, said diffuser section including a plurality of diffuser tubes, each of said tubes having a generally polygonal inlet having a plurality of generally straight sides, said tubes being contiguously nested such that a side of an inlet of one of said tubes is adjacent a side of an inlet of another of said tubes.

2. The papermaking system of claim 1 wherein a side of an inlet of each of said tubes is adjacent a side of an inlet of another of said tubes.

3. The papermaking system of claim 1 wherein each side of an inlet of each tube is adjacent a side of an inlet of any adjacent tube.

4. The papermaking system of claim 1 wherein each side of said inlet of said one of said tubes is adjacent a side of an inlet of another of said tubes.

5. The papermaking system of claim 1 wherein said tubes are nested such that there is generally no space between said side of said inlet of said one of said tubes and said side of said inlets of said another of said tubes.

6. The papermaking system of claim 1 wherein each inlet is generally shaped as a regular polygon in end view.

7. The papermaking system of claim 1 wherein said polygonal inlet is generally hexagonal in end view.

8. The papermaking system of claim 1 wherein each tube includes a diverging section adjacent an outlet of said tube.

9. The papermaking system of claim 8 wherein each tube includes a converging section adjacent said inlet.

10. The papermaking system of claim 9 wherein each tube includes a throat section between said converging section and said diverging section, said throat section having a generally uniform diameter.

11. The papermaking system of claim 1 wherein an outlet of each tube is generally polygonal in end view.

12. The papermaking system of claim 1 wherein when fluid is passed through said diffuser section each tube has a generally vortex-free flow at an outlet of said tube.

13. The papermaking system of claim 11 wherein at least one of said diffuser tubes is located adjacent to at least three diffuser tubes.

14. The papermaking system of claim 1 wherein the diffuser section includes an array of diffuser tubes.

15. The papermaking system of claim 14 wherein said array includes at least two stacked rows of diffuser tubes.

16. The papermaking system of claim 1 wherein each diffuser tube includes at least one wall defining the periphery of said tube.

17. The papermaking system of claim 1 wherein each diffuser tube is separable from any adjacent tubes.

18. A papermaking system comprising:

a distributor for receiving a flow of pulp;

a nozzle for depositing a flow of pulp onto a conveyer; and a diffuser section for delivering said flow of pulp from said distributor to said nozzle, said diffuser section comprising an array of at least two rows of diffusers, each diffuser having a central passage and a generally polygonal inlet, said diffusers being arranged such that each inlet is located adjacent an inlet of another diffuser with generally no gaps therebetween.

19. The system of claim 18 wherein at least one of said diffusers is located adjacent to at least three diffusers.

20. The system of claim 18 wherein each diffuser is a tube and includes an outer wall defining said diffuser, each outer wall including a plurality of sides, at least one of said sides being contiguously arranged against a side of an outer wall of an adjacent diffuser.

21. The system of claim 18 wherein each diffuser is separable from any adjacent diffusers.

22. A method for depositing pulp comprising the steps of:

providing a distributor, a diffuser section in fluid communication with said distributor, and a nozzle in fluid communication with said diffuser section, said diffuser section including a plurality of hollow diffuser tubes, each diffuser tube having an outlet and a generally polygonal inlet arranged such that the inlet of each diffuser tube abuts against the inlet of an adjacent diffuser tube such that there are generally no gaps therebetween;

causing a flow of pulp to enter said distributor;

causing at least part of said flow to exit said distributor and flow through said hollow diffuser tubes of said diffuser section; and causing at least part of said flow to exit said diffuser section and flow through said nozzle and such that said nozzle deposits said pulp onto a conveyer.

23. The method of claim 22 wherein said pulp flows through said diffuser tubes such that the flow of pulp through each diffuser tube is agitated while the generation of vortices in said flow is minimized.

24. The method of claim 22 wherein said distributor tends to normalize the properties of said pulp flow while said pulp flow is in said distributor.

25. The method of claim 22 wherein at least one of said diffuser tubes is located adjacent to at least three diffuser tubes.

26. The method of claim 22 wherein the diffuser section includes at least two rows of stacked diffuser tubes.

* * * * *